US006755974B2

(12) United States Patent
Greaney et al.

(10) Patent No.: US 6,755,974 B2
(45) Date of Patent: Jun. 29, 2004

(54) CONTINUOUS NAPHTHA TREATMENT METHOD

(75) Inventors: Mark A. Greaney, Upper Black Eddy, PA (US); Binh N. Le, Humble, TX (US); Daniel P. Leta, Flemington, NJ (US); John N. Begasse, Livingston, NJ (US); Charles T. Huang, Houston, TX (US); Verlin Keith Turner, LaPorte, TX (US); Gordon F. Stuntz, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 172 days.

(21) Appl. No.: 10/161,955

(22) Filed: Jun. 4, 2002

(65) Prior Publication Data

US 2003/0094414 A1 May 22, 2003

Related U.S. Application Data

(60) Provisional application No. 60/299,329, filed on Jun. 19, 2001, provisional application No. 60/299,330, filed on Jun. 19, 2001, provisional application No. 60/299,331, filed on Jun. 19, 2001, provisional application No. 60/299,346, filed on Jun. 19, 2001, and provisional application No. 60/299,347, filed on Jun. 19, 2001.

(51) Int. Cl.[7] ..... B01D 11/00

(52) U.S. Cl. ..... 210/638; 210/639; 210/763; 210/806; 208/234; 208/218

(58) Field of Search ..... 210/806, 763, 210/639, 638; 208/234, 235, 218

(56) References Cited

U.S. PATENT DOCUMENTS

| | | | | |
|---|---|---|---|---|
| 2,770,581 | A | 11/1956 | Brooks, Jr. et al. | 196/41 |
| 2,850,434 | A | 9/1958 | Brooks, Jr. et al. | 196/32 |
| 2,853,432 | A | 9/1958 | Gleim et al. | 196/32 |
| 2,868,722 | A | 1/1959 | Brooks, Jr. et al. | 208/263 |
| 2,882,224 | A | 4/1959 | Gleim et al. | 208/206 |
| 2,921,021 | A | 1/1960 | Urban et al. | 208/205 |
| 2,966,453 | A | 12/1960 | Gleim et al. | 208/206 |
| 2,976,229 | A | 3/1961 | Brown et al. | 208/2 |
| 3,186,934 | A | 6/1965 | Neilsen | 208/2 |
| 3,445,380 | A | 5/1969 | Urban | 208/206 |
| 3,977,829 | A | 8/1976 | Clonts | 23/267 |
| 3,992,156 | A | 11/1976 | Clonts | 23/267 |
| 4,040,947 | A | 8/1977 | Christman | 208/235 |
| 4,104,155 | A | 8/1978 | Christman | 208/235 |
| 4,265,735 | A | 5/1981 | Audeh et al. | 208/234 |
| 4,362,614 | A | 12/1982 | Asdigian | 208/235 |
| 4,404,098 | A | 9/1983 | Asdigian | 208/235 |
| 4,753,722 | A | 6/1988 | Le et al. | 208/207 |
| 5,318,690 | A | 6/1994 | Fletcher et al. | 208/89 |
| 5,360,532 | A | 11/1994 | Fletcher et al. | 208/89 |
| 5,569,788 | A | 10/1996 | Forte et al. | 568/697 |
| 5,582,714 | A | 12/1996 | Forte | 208/237 |

(List continued on next page.)

OTHER PUBLICATIONS

C. A. Duval and V. A. Kalichevsky, Magnolia Petroleum Co., Beaumont, TX, "Dualayer Gasoline Treating Process," Petroleum Refiner, Apr., 1954, vol. 33, No. 4, pp. 161–163.

C. A. Duval and V. A. Kalichevsky, "Treating Gasoline by Dualayer Process," The Oil and Gas Journal, Apr. 12, 1954, pp. 122–123, 150–151.

V. A. Kalichevsky, Magnolia Petroleum Co., Beaumont, TX, "New Mercaptan–Removal Process," The Oil Forum, Jun., 1954, pp. 194–195.

*Primary Examiner*—Terry K. Cecil
(74) *Attorney, Agent, or Firm*—Gerard J. Hughes

(57) ABSTRACT

The invention relates to a method for treating naphtha, such as catalytically cracked naphtha, in order to remove acidic impurities, such as mercaptans. In particular, the invention relates to a method for mercaptans having a molecular weight of about $C_4$ ($C_4H_{10}S$=90 g/mole) and higher, such as recombinant mercaptans.

23 Claims, 2 Drawing Sheets

U.S. PATENT DOCUMENTS

| | | | | |
|---|---|---|---|---|
| 5,689,033 | A | 11/1997 | Forte et al. | 585/833 |
| 5,997,731 | A | 12/1999 | Suarez | 208/230 |
| 6,007,704 | A | 12/1999 | Chapus et al. | 208/218 |
| 6,126,814 | A | 10/2000 | Lapinski et al. | 208/217 |
| 6,228,254 | B1 | 5/2001 | Jossens et al. | 208/212 |
| 6,352,640 | B1 | 3/2002 | Cook et al. | 208/237 |
| 2003/0230517 | A1 * | 12/2003 | Groten | 208/209 |

* cited by examiner n=1 : 3-methyl phenol
n=2 : 2,4-dimethyl phenol
n=3 : 2,3,5 trimethyl phenol

CONTINUOUS NAPHTHA TREATMENT METHOD

CROSS-REFERENCE TO RELATED APPLICATIONS

This application claims benefit of U.S. Provisional Patent Applications Serial Nos. 60/299,329; 60/299,330; 60/299,331; 60/299,346; and 60/299,347, all filed on Jun. 19, 2001.

FIELD OF THE INVENTION

The invention relates to a method for treating naphtha, such as catalytically cracked naphtha, in order to remove acidic impurities, such as mercaptans. In particular, the invention relates to a method for mercaptans having a molecular weight of about $C_4$ ($C_4H_{10}S$=90 g/mole) and higher, such as recombinant mercaptans.

BACKGROUND OF THE INVENTION

Undesirable acidic species such as mercaptans may be removed from naphtha and other liquid hydrocarbons with conventional aqueous treatment methods. In one conventional method, the naphtha contacts an aqueous treatment solution containing an alkali metal hydroxide. The naphtha contacts the treatment solution, and mercaptans are extracted from the naphtha to the treatment solution where they form mercaptide species. The naphtha and the treatment solution are then separated, and a treated naphtha is conducted away from the process. Intimate contacting between the naphtha and aqueous phase leads to more efficient transfer of the mercaptans from the naphtha to the aqueous phase, particularly for mercaptans having a molecular weight higher than about $C_4$. Such intimate contacting often results in the formation of small discontinuous regions (also referred to as "dispersion") of treatment solution in the naphtha. While the small aqueous regions provide sufficient surface area for efficient mercaptan transfer, they adversely affect the subsequent naphtha separation step and may be undesirably entrained in the treated naphtha.

Efficient contacting may be provided with reduced aqueous phase entrainment by employing contacting methods that employ little or no agitation. One such contacting method employs a mass transfer apparatus comprising substantially continuous elongate fibers mounted in a shroud. The fibers are selected to meet two criteria. The fibers are preferentially wetted by the treatment solution, and consequently present a large surface area to the naphtha without substantial dispersion or the aqueous phase in the naphtha. Even so, the formation of discontinuous regions of aqueous treatment solution is not eliminated, particularly in continuous process.

In another conventional method, the aqueous treatment solution is prepared by forming two aqueous phases. The first aqueous phase contains alkylphenols, such as cresols (in the form of the alkali metal salt), and alkali metal hydroxide, and the second aqueous phase contains alkali metal hydroxide. Upon contacting the hydrocarbon to be treated, mercaptans contained in hydrocarbon are removed from the hydrocarbon to the first phase, which has a lower mass density than the second aqueous phase. Undesirable aqueous phase entrainment is also present in this method, and is made worse when employing higher viscosity treatment solutions containing higher alkali metal hydroxide concentration.

There remains a need, therefore, for new naphtha treatment processes that curtail aqueous treatment solution entrainment in the treated naphtha, and are effective for removing acidic species such as mercaptan, especially high molecular weight and branched mercaptans.

SUMMARY OF THE INVENTION

In an embodiment, the invention relates to a continuous method for treating and upgrading a light and heavy naphtha containing mercaptans, particularly mercaptans having a molecular weight higher than about $C_4$ such as recombinant mercaptans, comprising:

(a) contacting in a first contacting region the light naphtha with a first phase of a treatment composition containing water, alkali metal hydroxide, cobalt phthalocyanine sulfonate, and alkylphenols and having at least two phases, wherein
  (i) the first phase contains dissolved alkali metal alkylphenylate, dissolved alkali metal hydroxide, water, and dissolved sulfonated cobalt phthalocyanine,
  (ii) at least a portion of the alkyl phenylate is derived from alkyl phenols in the heavy naphtha, and
  (iii) the second phase contains water and dissolved alkali metal hydroxide;

(b) extracting mercaptan sulfur from the light naphtha to the first phase, the light naphtha having a lower concentration of alkyl phenols than the heavy naphtha;

(c) contacting in a second contacting region the heavy naphtha with the first phase of the treatment composition, wherein,
  (i) the heavy naphtha has a higher boiling range than the light naphtha, and
  (ii) the heavy naphtha has a concentration of alkylphenols greater than the concentration in the light naphtha, (d) extracting mercaptan sulfur and alkylphenols from the heavy naphtha to the first phase;

(e) separating an upgraded light naphtha and separating an upgraded heavy naphtha; and (f) separating mercaptan sulfur from the first phase, and then conducting the extractant to at least one of step (a) for re-use.

In a preferred embodiment, the process involves conducting the first phase containing mercaptan sulfur from at least one of steps (b) and (d) and conducting an oxidizing amount of oxygen to an oxidizing region and oxidizing the mercaptan sulfur to disulfides; and then separating the disulfides from the first phase. Preferably the contacting is conducted under substantially anaerobic conditions, i.e., without adding oxygen in the contacting. Preferably, the extractant in step (f) is conducted to steps (a) and (c) for re-use.

In another embodiment, the invention relates to a method for treating and upgrading a light and heavy naphtha containing mercaptans, particularly mercaptans having a molecular weight higher than about $C_4$ such as recombinant mercaptans, comprising:

(a) contacting in a first region the light naphtha with an extractant composition containing water, dissolved alkali metal hydroxide, dissolved sulfonated cobalt phthalocyanine, and dissolved alkali metal alkylphenylates, wherein
  (i) the extractant is substantially immiscible with its analogous aqueous alkali metal hydroxide,
  (ii) at least a portion of the alkali metal alkylphenylate in the extractant is derived from alkyl phenols present in the heavy naphtha, and
  (iii) the light naphtha is substantially contains a lower concentration of alkyl phenols than the heavy naphtha;

(b) extracting mercaptan sulfur from the light naphtha to the extractant;

(c) contacting in a second contacting region the heavy naphtha with the extractant, wherein, (i) the heavy naphtha has a higher boiling range than the light naphtha, and (ii) the heavy naphtha has a concentration of alkylphenols greater than the concentration in the light naphtha, (d) extracting mercaptan sulfur and alkylphenols from the heavy naphtha to the extractant;

(e) separating an upgraded light naphtha and separating an upgraded heavy naphtha; and (f) separating mercaptan sulfur from the extractant, and then conducting the extractant to at least step (a) for re-use.

In a preferred embodiment, the process involves conducting the extractant containing mercaptan sulfur from at least one of steps (b) and (d) and conducting an oxidizing amount of oxygen to an oxidizing region and oxidizing the mercaptan sulfur to disulfides; and then separating the disulfides from the first phase. Preferably the contacting is conducted under substantially anaerobic conditions, i.e., without adding oxygen in the contacting. Preferably, the extractant in step (f) is conducted to steps (a) and (c) for re-use.

DETAILED DESCRIPTION OF THE INVENTION

The invention relates to obtaining at least a portion of the alkyl phenols for the treatment solution from the heavy naphtha, which is generally rich in both mercaptans and alkylphenols, and using the alkyl phenols derived from the heavy naphtha in removing mercaptans from the light naphtha, which is generally rich in mercaptans but lean in alkylphenols. The invention also relates in part to the discovery that aqueous treatment solution entrainment into the treated naphtha may be curtailed by adding to the treatment solution an effective amount of sulfonated cobalt phthalocyanine. While not wishing to be bound by any theory or model, it is believed that the presence of sulfonated cobalt phthalocyanine in the treatment solution lowers the interfacial energy between the aqueous treatment solution and the naphtha, which enhances the rapid coalescence of the discontinuous aqueous regions in the naphtha thereby enabling more effective separation of the treated naphtha from the treatment solution.

In one embodiment, the invention relates to processes for reducing the sulfur content of a light and heavy naphtha by the extraction of the acidic species such as mercaptans from the naphtha to an aqueous treatment solution where the mercaptans subsist as mercaptides, and then separating a treated light and heavy naphtha substantially reduced in mercaptans from the treatment solution while curtailing treatment solution entrainment in the treated naphthas. Preferably, the mercaptan extraction from the light naphtha is conducted in a first region or vessel and the extraction from the heavy naphtha is conducted in a second region or vessel physically separated from the first region or vessel. Preferably, the extraction of the mercaptans from the naphtha to the treatment solution is conducted under anaerobic conditions, i.e., in the substantial absence of added oxygen. In other embodiments, one or more of the following may also be incorporated into the process:

(i) stripping away the mercaptides from the treatment solution by e.g., steam stripping, (ii) catalytic oxidation of the mercaptides in the treatment solution to form disulfides which may be removed therefrom, and (iii) regenerating the treatment solution for re-use.

Sulfonated cobalt phthalocyanine may be employed as a catalyst when the catalytic oxidation of the mercaptides is included in the process.

Figure 2:
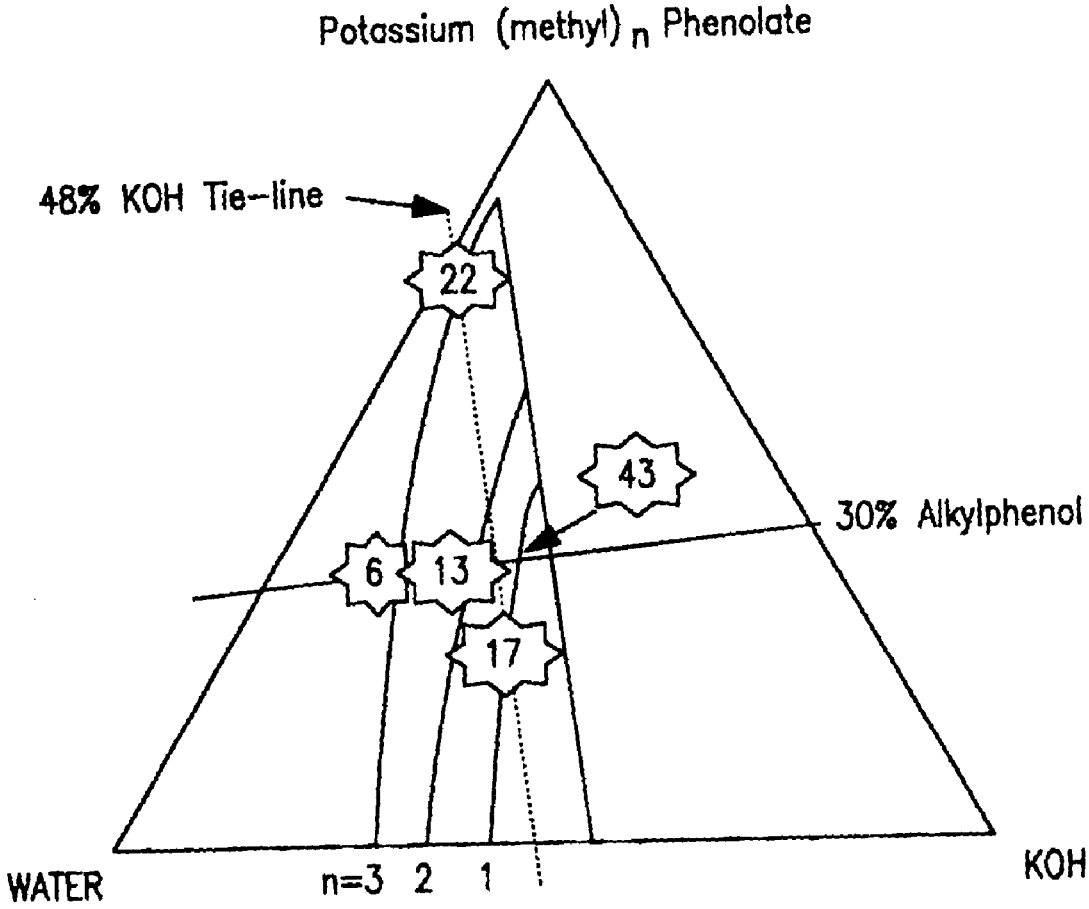
FIG. 2 shows a schematic phase diagram for a water-KOH-potassium alkyl phenylate treatment solution.

The treatment solution may be prepared by combining alkali metal hydroxide, alkylphenols, sulfonated cobalt pthalocyanine, and water. The amounts of the constituents may be regulated so that the treatment solution forms two substantially immiscible phases, i.e., a less dense, homogeneous, top phase of dissolved alkali metal hydroxide, alkali metal alkylphenylate, and water, and a more dense, homogeneous, bottom phase of dissolved alkali metal hydroxide and water. An amount of solid alkali metal hydroxide may be present, preferably a small amount (e.g., 10 wt. % in excess of the solubility limit), as a buffer, for example. When the treatment solution contains both top and bottom phases, the top phase is frequently referred to as the extractant or extractant phase. The top and bottom phases are liquid, and are substantially immiscible in equilibrium in a temperature ranging from about 80° F. to about 150° F. and a pressure range of about ambient (zero psig) to about 200 psig. Representative phase diagrams for a treatment solution formed from potassium hydroxide, water, and three different alkylphenols are shown in FIG. 2.

In one embodiment, therefore, a two-phase treatment solution is combined with the hydrocarbon to be treated and allowed to settle. Following settling, less dense treated hydrocarbon located above the top phase, and may be separated. In another embodiment, the top and bottom phases are separated before the top phase (extractant) contacts the hydrocarbon. As discussed, all or a portion of the top phase may be regenerated following contact with the hydrocarbon and returned to the process for re-use. For example, the regenerated top phase may be returned to the treatment solution prior to top phase separation, where it may be added to either the top phase, bottom phase, or both. Alternatively, the regenerated top phase may be added to the either top phase, bottom phase, or both subsequent to the separation of the top and bottom phases.

The treatment solution may also be prepared to produce a single liquid phase of dissolved alkali metal hydroxide, dissolved alkali metal alkylphenylate, dissolved sulfonated cobalt pthalocyanine, and water, provided the single phase is formed compositionally located on the phase boundary between the one-phase and two-phase regions of the ternary phase diagram. In other words, the top phase may be prepared directly without a bottom phase, provided the top phase composition is regulated to remain at the boundary between the one phase and two phase regions of the dissolved alkali metal hydroxide-alkali metal alkylphenylate-water ternary phase diagram. The compositional location of the treatment solution may be ascertained by determining its miscibility with the analogous aqueous alkali metal hydroxide. The analogous aqueous alkali metal hydroxide is the bottom phase that would be present if the treatment solution had been prepared with compositions within the two-phase region of the phase diagram. As the top phase and bottom phase are homogeneous and immiscible, a treatment solution prepared without a bottom phase will be immiscible with the analogous aqueous alkali metal hydroxide.

Once an alkali metal hydroxide and alkylphenol (or mixture of alkyl phenols) are selected, a phase diagram defining the composition at which the mixture subsists in a single phase or as two or more phases may be determined. The phase diagram may be represented as a ternary phase diagram as shown in FIG. 2. A composition in the two phase region is in the form of a less dense top phase on the boundary of the one phase and two phase regions an a more dense bottom phase on the water-alkali metal hydroxide axis. A particular top phase is connected to its analogous bottom phase by a unique tie line. The relative amounts of alkali metal hydroxide, alkyl phenol, and water needed to form the desired single phase treatment solution at the phase boundary may then be determined directly from the phase diagram. If it is found that a single phase treatment solution has been prepared, but is not compositionally located at the phase boundary as desired, a combination of water removal or alkali metal hydroxide addition may be employed to bring the treatment solution's composition to the phase boundary. Since properly prepared treatment solutions of this embodiment will be substantially immiscible with its analogous aqueous alkali metal hydroxide, the desired composition may be prepared and then tested for miscibility with its analogous aqueous alkali metal hydroxide, and compositionally adjusted, if required.

Accordingly, in another embodiment, a single-phase treatment solution is prepared compositionally located at the boundary between one and two liquid phases on the ternary phase diagram, and then contacted with the hydrocarbon. After the treatment solution has been used to contact the hydrocarbon, it may be regenerated for re-use, as discussed for two-phase treatment solutions, but no bottom phase is present in this embodiment. Such a single-phase treatment solution is also referred to as an extractant, even when no bottom phase is present. Accordingly, when the treatment solution is located-compositionally in the two-phase region of the phase diagram, the top phase is referred to as the extractant. When the treatment solution is prepared without a bottom phase, the treatment solution is referred to as the extractant.

While it is generally desirable to separate and remove sulfur from the hydrocarbon so as to form an upgraded hydrocarbon with a lower total sulfur content, it is not necessary to do so. For example, it may be sufficient to convert sulfur present in the feed into a different molecular form. In one such process, referred to as sweetening, undesirable mercaptans which are odorous are converted in the presence of oxygen to substantially less odorous disulfide species. The hydrocarbon-soluble disulfides then equilibrate (reverse extract) into the treated hydrocarbon. While the sweetened hydrocarbon product and the feed contain similar amounts of sulfur, the sweetened product contains less sulfur in the form of undesirable mercaptan species. The sweetened hydrocarbon may be further processed to reduce the total sulfur amount, by hydrotreating, for example.

The total sulfur amount in the hydrocarbon product may be reduced by removing sulfur species such as disulfides from the extractant. Therefore, in one embodiment, the invention relates to processes for treating a liquid hydrocarbon by the extraction of the mercaptans from the hydrocarbon to an aqueous treatment solution where the mercaptans subsist as water-soluble mercaptides and then converting the water-soluble mercaptides to water-insoluble disulfides. The sulfur, now in the form of hydrocarbon-soluble disulfides, may then be separated from the treatment solution and conducted away from the process so that a treated hydrocarbon substantially free of mercaptans and of reduced sulfur content may be separated from the process. In yet another embodiment, a second hydrocarbon may be employed to facilitate separation of the disulfides and conduct them away from the process.

While it is preferred that the process operate continuously, the process may be also be operated as a batch process where the extractant is conducted away from the process following separation of the treated naphthas. When operated continuously, the process may be operated so that the flow of the treatment solution is cocurrent to naphtha flow, countercurrent to naphtha flow, or a combination thereof. For example, the treatment solution flow may be cocurrent with the heavy naphtha, but countercurrent with the light naphtha.

In one embodiment, the light and heavy naphthas are derived or separated from a full range naphtha containing acidic species such as mercaptans and alkyl phenols such as cresols. Preferably, the light and heavy naphthas are separated or derived from a cracked naphtha such as an FCC naphtha or coker naphtha. Cracked naphthas boiling in the range of about 65° F. to about 430° F., ($C_5^+$), i.e., full range cracked naphthas are suitable. Such full range cracked naphtha streams can typically contain one or more mercaptan compounds, such as methyl mercaptan, ethyl mercaptan, n-propyl mercaptan, isopropyl mercaptan, n-butyl mercaptan, thiophenol and higher molecular weight mercaptans such as nonanethiol (boiling point about 430° F.). The mercaptan compound is frequently represented by the symbol RSH, where R is normal or branched alkyl, or aryl.

Light naphtha derived or separated from cracked naphtha generally boils in the range of about $C_5$ to 140° F., preferably about $C_5$ to about 130° F., depending on the distillation cut-point. The lower end of the light naphtha boiling range-may be as low as about 50° F. or even lower, as is known to those skilled in naphtha separation. Light naphtha may therefore contain methyl and ethyl mercaptans. However, alkyl phenols, have boiling points above the light naphtha boiling range, e.g., methyl phenol has a boiling point in the range of about 375° F. to about 400° F.

Heavy naphtha derived or separated from cracked naphtha generally boils in the range of about 140° F. to about 430° F. The lower limit of the boiling range may be as low as about 130° F., and the upper limit of the boiling range may be substantially lower than 430° F. (e.g., about 400° F. or lower) depending on the distillation cut-point, as is known to those skilled in the art. The heavy naphtha may therefore contain mercaptans up to about $C_9$ (nonanethiol) and alkyl phenols such as methyl phenols. The light naphtha therefore contains mercaptans but is relatively lean in alkylphenols (i.e., too little to form a treatment solution capable of extracting the light naphtha's mercaptans) while the heavy naphtha contains mercaptans and is relatively rich in alkylphenols. It is consequently within the scope of the method to use a single treatment solution for extracting mercaptans from both the light and heavy naphtha while deriving at least a portion of the alkylphenols for the treatment solution from the heavy naphtha. Generally, the light naphtha contains alkylphenols present in an amount ranging from about zero wppm to about 1000 wppm, more typically they are not present in a sufficient concentration to form the desired treatment solution. Preferably, the heavy naphtha contains alkylphenols in an amount ranging from about 100 wppm to about 2000 wppm, and typically it contains sufficient alkylphenols to form a treatment solution capable of extracting mercaptans from both the light and heavy naphtha.

Mercaptans and other sulfur-containing species, such as thiophenes, often form during heavy oil and resid cracking and coking and as a result of their similar boiling ranges are frequently present in the cracked products. Cracked naphtha, such as FCC naphtha, coker naphtha, and the like, also may contain desirable olefin species that when present contribute to an enhanced octane number for the cracked product. While hydrotreating may be employed to remove undesirable sulfur species and other heteroatoms from the cracked naphtha, it is frequently the objective to do so without undue olefin saturation. Hydrodesulfurization without undue olefin saturation is frequently referred to as selective hydrotreating. Unfortunately, hydrogen sulfide formed during hydrotreating reacts with the preserved olefins to form mercaptans. Such mercaptans are referred to as reversion or recombinant mercaptans to distinguish them from the mercaptans present in the cracked naphtha conducted to the hydrotreater. Such reversion mercaptans generally have a molecular weight ranging from about 90 to about 160 g/mole, and generally exceed the molecular weight of the mercaptans formed during heavy oil, gas oil, and resid cracking or coking, as these typically range in molecular weight from 48 to about 76 g/mole. The higher molecular weight of the reversion mercaptans and the branched nature of their hydrocarbon component make them more difficult to remove from the naphtha using conventional caustic extraction. Accordingly, a preferred heavy naphtha is a hydrotreated naphtha boiling in the range of about 130° F. to about 350° F. and containing reversion mercaptan sulfur in an amount ranging from about 10 to about 100 wppm, based on the weight of the hydrotreated naphtha. More preferred is a selectively hydrotreated heavy naphtha, i.e., one that is more than 80 wt. % (more preferably 90 wt. % and still more preferably 95 wt. %) desulftirized compared to the hydrotreater feed but with more than 30% (more preferably 50% and still more preferably 60%) of the olefins retained based on the amount of olefin in the hydrotreater feed.

Process details relating to the contacting with the treatment solution are generally similar for the light and heavy naphtha. Therefore, the naphtha to be treated, whether light or heavy, is contacted in one embodiment with a first phase of an aqueous treatment solution having two phases. The first phase contains dissolved alkali metal hydroxide, water, alkali metal alkylphenylate, and sulfonated cobalt phthalocyanine, and the second phase contains water and dissolved alkali metal hydroxide. Preferably, the alkali metal hydroxide is potassium hydroxide. The contacting between the treatment solution's first phase and the naphtha may be liquid-liquid. Alternatively, a vapor naphtha may contact a liquid treatment solution. Conventional contacting equipment such as packed tower, bubble tray, stirred vessel, fiber contacting, rotating disc contactor and other contacting apparatus may be employed. Fiber contacting is preferred. Fiber contacting, also called mass transfer contacting, where large surface area provides for mass transfer in a non-dispersive manner is described in U.S. Pat. Nos. 3,997,829; 3,992,156; and 4,753,722. While contacting temperature and pressure may range from about 80° F. to about 150° F. and 0 psig to about 200 psig, preferably the contacting occurs at a temperature in the range of about 100° F. to about 140° F. and a pressure in the range of about 0 psig to about 200 psig, more preferably about 50 psig. Higher pressures during contacting may be desirable to elevate the boiling point of the naphtha so that the contacting may conducted with the hydrocarbon in the liquid phase.

The treatment solution employed contains at least two aqueous phases, and is formed by combining alkylphenols, alkali metal hydroxide, sulfonated cobalt phthalocyanine, and water. Preferred alkylphenols include cresols, xylenols, methylethyl phenols, trimethyl phenols, naphthols, alkylnaphthols, thiophenols, alkylthiophenols, and similar phenolics. Cresols are particularly preferred. When alkylphenols are present in the hydrocarbon to be treated, all or a portion of the alkylphenols in the treatment solution may be obtained from the hydrocarbon feed. Sodium and potassium hydroxide are preferred metal hydroxides, with potassium hydroxide being particularly preferred. Di-, tri- and tetra-sulfonated cobalt pthalocyanines are preferred cobalt pthalocyanines, with cobalt phthalocyanine disulfonate being particularly preferred. The treatment solution components are present in the following amounts, based on the weight of the treatment solution: water, in an amount ranging from about 10 to about 50 wt. %; alkylphenol, in an amount ranging from about 15 to about 55 wt. %; sulfonated cobalt phthalocyanine, in an amount ranging from about 10 to about 500 wppm; and alkali metal hydroxide, in an amount ranging from about 25 to about 60 wt. %. The extractant should be present in an amount ranging from about 3 vol. % to about 100 vol. %, based on the volume of hydrocarbon to be treated.

As discussed, the treatment solution's components may be combined to form a solution having a phase diagram such as shown in FIG. 2, which shows the two-phase region for three different alkyl phenols, potassium hydroxide, and water. The preferred treatment solution has component concentrations such that the treatment solution will either (i) be compositionally in the two-phase region of the water-alkali metal hydroxide-alkali metal alkylphenylate phase diagram and will therefore form a top phase compositionally located at the phase boundary between the one and two-phase regions and a bottom phase, or (ii) be compositionally located at the phase boundary between the one and two-phase regions, with no bottom phase.

Following selection of the alkali metal hydroxide and the alkylphenol or alkylphenol mixture, the treatment solution's ternary phase diagram may be determined by conventional methods thereby fixing the relative amounts of water, alkali metal hydroxide, and alkyl phenol. The phase diagram can be empirically determined when the alkyl phenols are obtained from the hydrocarbon. Alternatively, the amounts and species of the alkylphenols in the hydrocarbon can be measured, and the phase diagram determined using conventional thermodynamics. The phase diagram is determined when the aqueous phase or phases are liquid and in a temperature in the range of about 80° F. to about 150° F. and a pressure in the range of about ambient (0 psig) to about 200 psig. While not shown as an axis on the phase diagram, the treatment solution contains dissolved sulfonated cobalt phthalocyanine. By dissolved sulfonated cobalt pthalocyanine, it is meant dissolved, dispersed, or suspended, as is known.

Whether the treatment solution is prepared in the two-phase region of the phase diagram or prepared at the phase boundary, the extractant will have a dissolved alkali metal alkylphenylate concentration ranging from about 10 wt. % to about 95 wt. %, a dissolved alkali metal hydroxide concentration in the range of about 1 wt. % to about 40 wt. %, and about 10 wppm to about 500 wppm sulfonated cobalt pthalocyanine, based on the weight of the extractant with the balance being water. When present, the second (or bottom) phase will have an alkali metal hydroxide concentration in the range of about 45 wt. % to about 60 wt. %, based on the weight of the bottom phase, with the balance being water.

When extraction of higher molecular weight mercaptans from the heavy naphtha (about $C_4$ and above, preferably about $C_5$ and above, and particularly from about $C_5$ to about $C_8$) is desired, such as in reversion mercaptan extraction, it is preferable to form the treatment solution towards the right hand side of the two-phase region, i.e., the region of higher alkali metal hydroxide concentration in the bottom phase. It has been discovered that higher extraction efficiency for the higher molecular weight mercaptans can be obtained at these higher alkali metal hydroxide concentrations. The conventional difficulty of treatment solution entrainment in the treated hydrocarbon, particularly at the higher viscosities encountered at higher alkali metal hydroxide concentration, is overcome by providing sulfonated cobalt phthalocyanine in the treatment solution. As is clear from FIG. 2, the mercaptan extraction efficiency is set by the concentration of alkali metal hydroxide present in the treatment solution's bottom phase, and is substantially independent of the amount and molecular weight of the alkylphenol, provided more than a minimum of about 5 wt. % alkylphenol is present, based on the weight of the treatment solution.

The extraction efficiency, as measured by the extraction coefficient, $K_{eq}$, shown in FIG. 2 is preferably higher than about 10, and is preferably in the range of about 20 to about 60. Still more preferably, the alkali metal hydroxide in the treatment solution is present in an amount within about 10% of the amount to provide saturated alkali metal hydroxide in the second phase. As used herein, $K_{eq}$ is the concentration of mercaptide in the extractant divided by the mercaptan concentration in the product, on a weight basis, in equilibrium, following mercaptan extraction from the feed hydrocarbon to the extractant.

Figure 1:
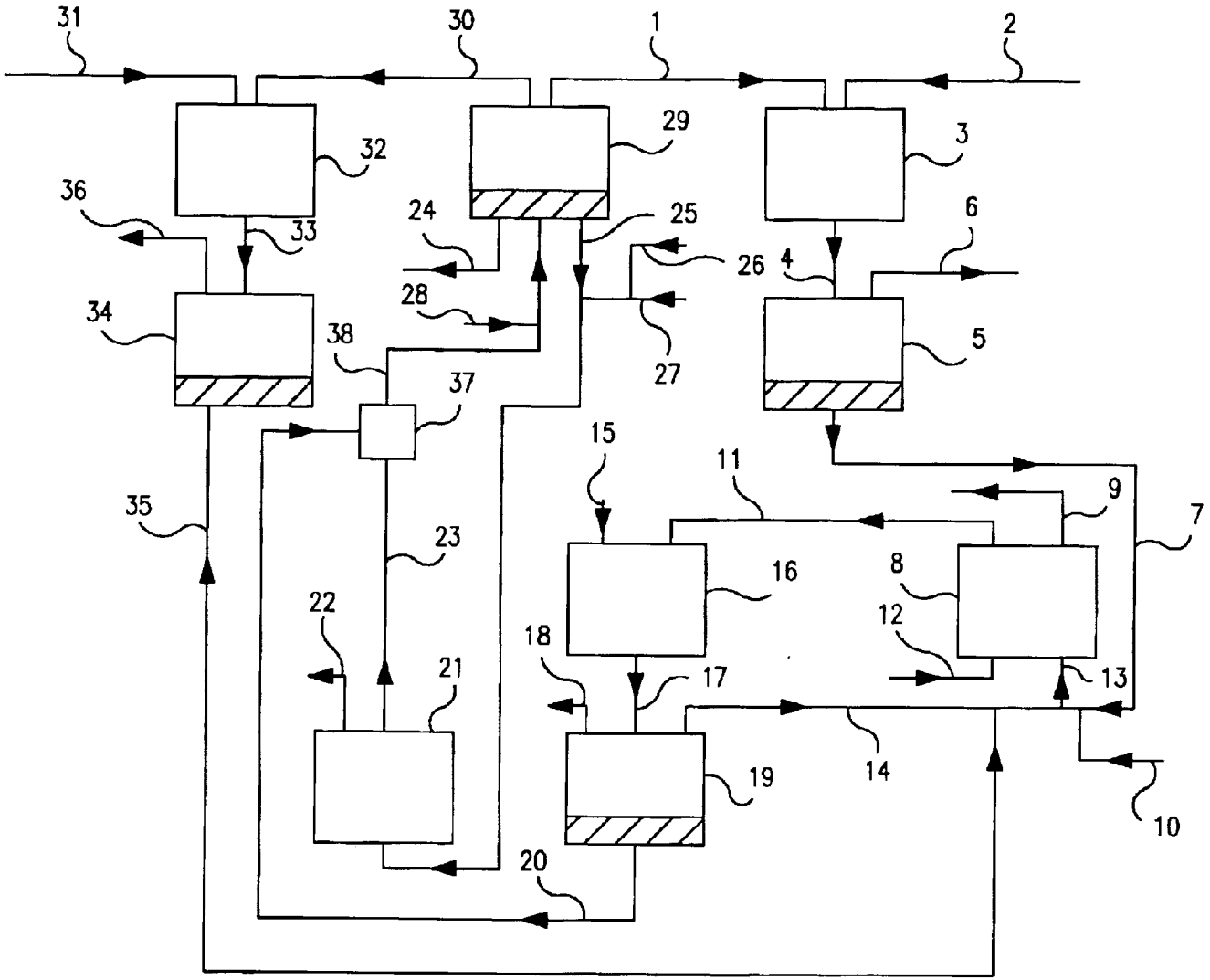
FIG. 1 shows a schematic flow diagram for one embodiment.

A simplified flow diagram for one embodiment is illustrated in FIG. 1. Extractant (comprising the treatment composition's top phase) in line 1 and a heavy naphtha feed in line 2 are conducted to a first contacting region 3 where mercaptans and alkylphenols are removed from the heavy naphtha to the extractant. Heavy naphtha and extractant are conducted through line 4 to first settling region 5 where the treated heavy naphtha is separated and conducted away from the process via line 6. The extractant, now containing mercaptan sulfur in the form of mercaptides, is shown in the lower (hatched) portion of the settling region.

In an embodiment, the extractant is conducted via lines 7 and 13 to oxidizing region 8 where the mercaptides in the extractant are oxidized to disulfides in the presence of an oxygen-containing gas conducted to region 8 via line 10 and a catalytically effective amount sulfonated cobalt pthalocyanine acting as an oxidation catalyst. Conventional oxidation conditions may be employed. If additional sulfonated cobalt pthalocyanine is required to make a catalytically effective amount in region 8, additional amount may be added via line 12. Undesirable oxidation by-products such as water and off-gasses may be conducted away from the process via line 9. The disulfides may be separated from the extractant and conducted away from the process, for example, disulfides may be separated and combined with the heavy naphtha of line 6 (not shown). Hydrocarbon (e.g., solvent) may be conducted to oxidation region 8 to assist in disulfide separation, via line 14. In one embodiment, the contacting and settling as shown in regions 3 and 5 (and 15 and 19; and 32 and 34) may occur in a common vessel with no interconnecting lines. In that embodiment, fiber contacting is particularly preferred.

In an embodiment, the extractant, hydrocarbon solvent, and disulfides are conducted away from oxidation region 8 via line 11 to second contacting region 16 where the extractant, disulfides, and hydrocarbon solvent are contacted with fresh hydrocarbon conducted to region 16 via line 15. As in the first contacting region, conventional contacting may be employed, and fiber contacting is preferred. Effluent from the second contacting region is conducted to second settling region 19 via line 17. Hydrocarbon solvent, containing disulfides, is conducted away from the process via line 18. Extractant shown in the shaded portion of the second settling region, now with diminished disulfide concentration, is conducted via line 20 to mixing region 37 and then returned to the bottom phase in the lower (hatched) portion of region 29. The concentrating region 21 regulates extractant composition by removing water via line 22, by e.g., steam stripping or another conventional water removal process. Alkali metal hydroxide and water may be added via lines 26, and 27 and conducted to concentrating region 21 via line 25 to further regulate the extractant's composition. Treatment solution may be conducted away from the process via line 24. Alkylphenols, if needed, may be added via line 28 and conducted to the treatment solution via line 38.

In an embodiment, light naphtha via line 31 and extractant via line 30 are conducted to third contacting region 32 where mercaptans are extracted from the light naphtha. Effluent from the third contacting region is conducted to fourth settling region 34 where upgraded light naphtha having a diminished mercaptan concentration is conducted away from the process via line 36. Extractant containing mercaptan sulfur in the form of mercaptides is conducted to oxidation region 8 via lines 35 and 13 for regeneration, as discussed for the heavy naphtha.

EXAMPLE 1

Impact of Sulfonated Cobalt Pthalocyanine on Droplet Size Distribution

A LASENTECH™ (Laser Sensor Technology, Inc., Redmond, Wash. USA), Focused Laser Beam Reflecatance Measuring Device (FBRM®) was used to monitoy the size of dispersed aqueous potassium cresylate droplets in a continuous naphtha phase. The instrument measures the back-reflectance from a rapidly spinning laser beam to determine the distribution of "chord lengths" for particles that pass through the point of focus of the beam. In the case of spherical particles, the chord length is directly proportional to particle diameter. The data is collected as the number of counts per second sorted by chord length in one thousand linear size bins. Several hundred thousand chord lengths are typically measured per second to provide a statistically significant measure of chord length size distrbution. This methodology is especially suited to detecting changes in this distribution as a function of changing process variables.

In this experiment, a representative treatment solution was prepared by combining 90 grams of KOH, 50 grams of water and 100 grams of 3-ethyl phenol at room temperature. After stirring for thirty minutes, the top and bottom phases were allowed to separate and the less dense top phase was utilized as the extractant. The top phase had a composition of about 36 wt. % KOH ions, about 44 wt. % potassium 3-ethyl phenol ions, and about 20 wt. % water, based on the total weight of the top phase, and the bottom phase contained approximately 53 wt. % KOH ions, with the balance water, based on the weight of the bottom phase.

First, 200 mls of light virgin naphtha was stirred at 400 rpm and the FBRM probe detected very low counts/sec to determine a background noise level. Then, 20 mls of the top phase from the KOH/alkyl phenol/water mixture described above was added. The dispersion that formed was allowed to stir for 10 minutes at room temperature. At this time the FBRM provided a stable histogram for the chord length distribution. Then, while still stirring at 400 rpm, a sulfonated cobalt pthalocyanine was added. The dispersion immediately responded to the addition, with the FBRM recording a significant and abrupt change in the chord length distribution. Over the course of another five minutes, the solution stabilized at a new chord length distribution. The most noticeable impact of the addition of sulfonated cobalt pthalocyanine was to shift the median chord length to larger values (length weighted): without sulfonated cobalt pthalocyanine, 14 microns; after addition of sulfonated cobalt pthalocyanine, 35 microns.

It is believed that the sulfonated cobalt pthalocyanine acts to reduce the surface tension of the dispersed extractant droplets, which results in their coalescence into larger median size droplets. In a preferred embodiment, where non-dispersive contacting is employed using, e.g., a fiber contactor, this reduced surface tension has two effects. First, the reduced surface tension enhances transfer of mercaptides from the naphtha phase into the extractant which is constrained as a film on the fiber during the contacting. Second, any incidental entrainment would be curtailed by the presence of the sulfonated cobalt pthalocyanine.

EXAMPLE 2

Determination of Extraction Coefficients for Selectively Hydrotreated Naphtha Determination of mercaptan extraction coefficient, $K_{eq}$, was conducted as follows. About 50 mls of selectively hydrotreated naphtha was poured into a 250 ml Schlenck flask to which had been added a Teflon-coated stir bar. This flask was attached to an inert gas/vacuum manifold by rubber tubing. The naphtha was degassed by repeated evacuation/nitrogen refill cycles (20 times). Oxygen was removed during these experiments to prevent reacting the extracted mercaptide anions with oxygen, which would produce naphtha-soluble disulfides. Due to the relatively high volatility of naphtha at room temperature, two ten mls sample of the degassed naphtha were removed by syringe at this point to obtain total sulfur in the feed following degassing. Typically the sulfur content was increased by 2–7-wppm sulfur due to evaporative losses. Following degassing, the naphtha was placed in a temperature-controlled oil bath and equilibrated at 120° F. with stirring. Following a determination of the ternary phase diagram for the desired components, the extractant for the run was prepared so that it was located compositionally in the two-phase region. Excess extractant was also prepared, degassed, the desired volume is measured and then transferred to the stirring naphtha by syringe using standard inert atmosphere handling techniques. The naphtha and extractant were stirred vigorously for five minutes at 120° F., then the stirring was stopped and the two phases were allowed to separate. After about five minutes, twenty mls of extracted naphtha were removed while still under nitrogen atmosphere and loaded into two sample vials. Typically, two samples of the original feed were also analyzed for a total sulfur determination, by x-ray fluorescence. The samples are all analyzed in duplicate, in order to ensure data integrity. The reasonable assumption was made that all sulfur removed from the feed resulted from mercaptan extraction into the aqueous extractant. This assumption was verified on several runs in which the mercaptan content was measured. As discussed, the Extraction Coefficient, $K_{eq}$, is defined as the ratio of sulfur concentration present in the form of mercaptans ("mercaptan sulfur") in the extractant divided by the concentration of sulfur in the form or mercaptides (also called "mercaptan sulfur") in the selectively hydrotreated naphtha following extraction:

$$K_{eq} = \frac{[RS^- M^+ \text{ in extractant}]}{[RSH \text{ in feed}]} \text{ after extraction.}$$

EXAMPLE 3

Extraction Coefficients Determined at Constant Cresol Weight %

As is illustrated in FIG. 2 the area of the two-phase region in the phase diagram increases with alkylphenol molecular weight. These phase diagrams were determined experimentally by standard, conventional methods. The phase boundary line shifts as a function of molecular weight and also determines the composition of the extractant phase within the two-phase region. In order to compare the extractive power of two-phase extractants prepared from different molecular weight alkylphenols, extractants were prepared having a constant, alkylphenol content in the top layer of about 30 wt. %. Accordingly, starting composition were selected for each of three different molecular weight alkylphenols to achieve this concentration in the extractant phase. On this basis, 3-methylphenol, 2,4-dimethylphenol and 2,3,5-trimethylphenol were compared and the results are depicted in FIG. 2.

The figure shows the phase boundary for each of the alkylphenols with the 30% alkylphenol line is shown as a sloping line intersecting the phase boundary lines. The measured $K_{eq}$ for each extractant, on a wt./wt. basis are noted at the point of intersection between the 30% alkyl phenol line and the respective alkylphenol phase boundary. The measured $K_{eq}$s for 3-methylphenol, 2,4-dimethylphenol, and 2,3,5-trimethylphenol were 43, 13, and 6 respectively. As can be seen in this figure, the extraction coefficients for the two-phase extractant at constant alkylphenol content drop significantly as the molecular weight of the alkylphenol increases. Though the heavier alkylphenols produce relatively larger two-phase regions in the phase diagram, they exhibit reduced mercaptan extraction power for the extractants obtained at a constant alkylphenol content. A second basis for comparing the extractive power of two-phase extractant systems is also illustrated in FIG. 2. The dashed 48% KOH tie-line delineates compositions in the phase diagram which fall within the two-phase region and share the same second phase (or more dense phase, frequently referred to as a bottom phase) composition: 48 wt. % KOH. All starting compositions along this tie-line will phase separate into two phases, the bottom phase of which will be 48 wt. % KOH in water. Two extractant compositions were prepared such that they fell on this tie-line although they were prepared using different molecular weight alkylphenols: 3-methyl phenol and 2,3,5 trimethylphenol. The extraction coefficients were determined as described above and were found to be 17 and 22 respectively. Surprisingly, in contrast to the constant alkylphenol content experiments in which large differences in extractive power were observed, these two extractants showed nearly identical $K_{eq}$. This example demonstrates that the mercaptan extraction efficiency is determined by the concentration of alkali metal hydroxide present in the bottom phase, and is substantially independent of the amount and molecular weight of the alkyl phenol.

EXAMPLE 4

Measurement of Mercaptan Removal from Naphtha

A representative treatment solution was prepared by combining 458 grams of KOH, 246 grams of water and 198 grams of alkyl phenols at room temperature. After stirring for thirty minutes, the mixture was allowed to separate into two phases, which were separated. The extractant (less dense) phase had a composition of about 21 wt. % KOH ions, about 48 wt. % potassium methyl phenylate ions, and about 31 wt. % water, based on the total weight of the extractant, and the bottom (more dense) phase contained approximately 53 wt % KOH ions, with the balance water, based on the weight of the bottom phase.

One part by weight of the extractant phase was combined with three parts by weight of a selectively hydrotreated intermediate cat naphtha ("ICN") having an initial boiling point of about 90° F. The ICN contained $C_6$, $C_7$, and $C_8$ recombinant mercaptans. The ICN and extractant were equilibrated at ambient pressure and 135° F., and the concentration of $C_6$, $C_7$, and $C_8$ recombinant mercaptan sulfur in the naphtha and the concentration of $C_6$, $C_7$, and $C_8$ recombinant mercaptan sulfur in the extractant were determined. The resulting $K_{eq}$ s were calculated and are shown in column 1 of the table.

For comparison, a conventional (from the prior art) extraction of normal mercaptans from gasoline using a 15 wt. % sodium hydroxide solution at 90° F. is shown in column 2 of the table. The comparison demonstrates that the extraction power of the more difficult to extract recombinant mercaptans using the instant process is more than 100 times greater than the extractive power of the conventional process with the less readily extracted normal mercaptans.

| Mercaptan Molecular Weight | $K_{eq}$, Extractant from top phase | $K_{eq}$, Single phase extractant |
|---|---|---|
| $C_1$ | — | 1000 |
| $C_2$ | — | 160 |
| $C_3$ | — | 30 |
| $C_4$ | — | 5 |
| $C_5$ | — | 1 |
| $C_6$ | 15.1 | 0.15 |
| $C_7$ | 7.6 | 0.03 |
| $C_8$ | 1.18 | Not measurable |

As is clear from the table, greatly enhanced $K_{eq}$ is obtained when the extractant is the top phase of a two-phase treatment solution compared with a conventional extractant, i.e., an extractant obtained from a single-phase treatment solution not compositionally located on the boundary between the one phase and two-phase regions. The top phase extractant is particularly effective for removing high molecular weight mercaptans. For example, for $C_6$ mercaptans, the $K_{eq}$ of the top phase extractant is one hundred times larger than the $K_{eq}$ obtained using an extractant prepared from a single-phase treatment solution. The large increase in $K_{eq}$ is particularly surprising in view of the higher equilibrium temperature employed with the top phase extractant because conventional kinetic considerations would be expected to lead to a decreased $K_{eq}$ as the equilibrium temperature was increased from 90° F. to 135° F.

EXAMPLE 5

Mercaptan Extraction from Natural Gas Condensates

A representative two-phase treatment solution was prepared as in as in Example 4. The extractant phase had a composition of about 21 wt. % KOH ions, about 48 wt. % potassium dimethyl phenylate ions, and about 31 wt. % water, based on the total weight of the extractant, and the bottom phase contained approximately 52 wt. % KOH ions, with the balance water, based on the weight of the bottom phase.

One part by weight of the extractant was combined with three parts by weight of a natural gas condensate containing branched and straight-chain mercaptans having molecular weights of about $C_5$ and above. The natural gas condensate had an initial boiling point of 91° F. and a final boiling point of 659° F., and about 1030 ppm mercaptan sulfur. After equilibrating at ambient pressure and 130° F., the mercaptan sulfur concentration in the extractant was measured and compared to the mercaptan concentration in the condensate, yielding a $K_{eq}$ of 11.27.

For comparison, the same natural gas condensate was combined on a 3:1 weight basis with a conventional extractant prepared from a conventional single phase treatment composition that contained 15% dissolved sodium hydroxide, i.e., a treatment composition compositionally located well away from the boundary with the two-phase region on the ternary phase diagram. Following equilibration under the same conditions, the mercaptan sulfur concentration was determined, yielding a much smaller $K_{eq}$ of 0.13. This example demonstrates that the extractant prepared from a two-phase treatment solution is nearly two orders of magnitude more effective in removing from a hydrocarbon branched and straight-chain mercaptans having a molecular weight greater than about $C_5$.

EXAMPLE 6

Reversion Mereaptan Extractive Power of Single Versus Two-Phase Extraction Compositions of Nearly Identical Composition Three treatment compositions were prepared (runs numbered 2, 4, and 6) compositionally located within the two-phase region. Following its separation from the treatment composition, the top phase (extractant) was contacted with naphtha as set forth in example 2, and the $K_{eq}$ for each extractant was determined. The naphtha contained reversion mercaptans, including reversion mercaptans having molecular weights of about $C_5$ and above. The results are set forth in the table.

By way of comparison, three conventional treatment compositions were prepared (runs numbered 1, 3, and 5) compositionally located in the single-phase region of the ternary phase diagram, but near the boundary of the two-phase region. The treatment compositions were contacted with the same naphtha, also under the conditions set forth in example 2, and the $K_{eq}$ was determined. These results are also set forth in the table.

For reversion mercaptan removal, the table clearly shows the benefit of employing extractant compositionally located on the phase boundary between the one-phase and two-phase regions of the phase diagram. Extractants compositionally located near the phase boundary, but within the one-phase region, show a $K_{eq}$ about a factor of two lower than the $K_{eq}$ of similar extractants compositionally located at the phase boundary.

| Run # | # of phases in treatment composition | K-cresylate (wt. %) | KOH (wt. %) | Water (wt. %) | Keq (wt./wt.) |
|---|---|---|---|---|---|
| 1 | 1 | 15 | 34 | 51 | 6 |
| 2 | 2 | 15 | 35 | 50 | 13 |
| 3 | 1 | 31 | 27 | 42 | 15 |
| 4 | 2 | 31 | 28 | 41 | 26 |
| 5 | 1 | 43 | 21 | 34 | 18 |
| 6 | 2 | 43 | 22 | 35 | 36 |

What is claimed is:

1. A continuous method for treating and upgrading a light and heavy naphtha containing mercaptans, comprising:

(a) contacting in a first contacting region the light naphtha conditions with a first phase of a treatment composition containing water, alkali metal hydroxide, cobalt phthalocyanine sulfonate, and alkylphenols and having at least two phases, wherein (i) the first phase contains dissolved alkali metal alkylphenylate, dissolved alkali metal hydroxide, water, and dissolved sulfonated cobalt phthalocyanine, (ii) at least a portion of the alkyl phenylate is derived from alkyl phenols in the heavy naphtha, and (iii) the second phase contains water and dissolved alkali metal hydroxide;

(b) extracting mercaptan sulfur from the light naphtha to the first phase, the light naphtha containing a concentration of alkyl phenols less than the heavy naphtha;

(c) contacting in a second contacting region the heavy naphtha with the first phase of the treatment composition, wherein, (i) the heavy naphtha has a higher boiling range than the light naphtha, and (ii) the heavy naphtha has a concentration of alkylphenols greater than that of the light naphtha, (d) extracting mercaptan sulfur and alkylphenols from the heavy naphtha to the first phase;

(e) separating an upgraded light naphtha and separating an upgraded heavy naphtha; and (f) separating mercaptan sulfur from the first phase, and then conducting the first phase to at least step (a) for re-use.

2. The method of claim 1 wherein, during the contacting of steps (a) and (c), the first phase is applied to and flows over and along hydrophylic metal fibers, and the naphtha flows over the first phase co-current with first phase flow.

3. The method of claim 2 wherein the heavy naphtha contains a hydrotreated naphtha and at least a portion of the mercaptans are reversion mercaptans.

4. The method of claim 3 wherein the hydrotreated naphtha is a selectively hydrotreated naphtha and wherein the reversion mercaptans have a molecular weight greater than about $C_4$.

5. The method of claim 4 wherein the reversion mercaptans have a molecular weight greater than about $C_5$.

6. The method of claim 1 wherein the sulfonated cobalt phthalocyanine is present in the first phase in an amount ranging from about 10 to about 500 wppm, based upon the weight of the treatment solution.

7. The method of claim 1 wherein the treatment solution contains about 15 wt. % to about 55 wt. % dissolved alkylphenols, about 10 wppm to about 500 wppm dissolved sulfonated cobalt phthalocyanine, about 25 wt. % to about 60 wt. % dissolved alkali metal hydroxide, and about 10 wt. % to about 50 wt. % water, based on the weight of the treatment solution.

8. The method of claim 7 wherein the first phase is present in steps (a) and (c) in an amount ranging from about 3 vol. % to about 100 vol. %, based on the volume of the naphtha, and the contacting is conducted in the substantial absence of oxygen.

9. The method of claim 1 wherein the alkylphenols are cresols.

10. The method of claim 1 wherein the light naphtha contains less than 1000 wppm alkylphenols, based on the weight of the light naphtha.

11. The method of claim 1 wherein the sulfonated cobalt phthalocyanine is cobalt phthalocyanine disulfonate.

12. The method of claim 1 wherein the treatment composition is formed by combining water in an amount ranging from about 10 wt. % to about 50 wt. %, alkali metal hydroxide in an amount ranging from about 25 wt. % to about 60 wt. %, sulfonated cobalt phthalocyanine in an amount ranging from about 10 ppm to about 500 ppm, and alkylphenols in an amount ranging from about 10 wt. % to about 50 wt. % based on the weight of the treatment solution.

13. The method of claim 12 wherein the contacting of steps (a) and (c) is conducted in the substantial absence of oxygen.

14. The method of claim 13 wherein the mercaptan sulfur is separated from the first phase in step (f) by (i) converting the mercaptan sulfur to hydrocarbon-soluble disulfides in an oxidizing region in the presence of oxygen and a catalytically effective amount of sulfonated cobalt pthalocyanine, (ii) separating the disulfides from the first phase, and then (iii) conducting the first phase to at least one of steps (a) and (c) for re-use.

15. A method for treating and upgrading a light and heavy naphtha containing mercaptans, comprising:

(a) contacting in a first contacting region the light naphtha with an extractant composition containing water, dissolved alkali metal hydroxide, dissolved sulfonated cobalt phthalocyanine, and dissolved alkali metal alkylphenylates, wherein (i) the extractant is substantially immiscible with its analogous aqueous alkali metal hydroxide, (ii) at least a portion of the alkali metal alkylphenylate in the extractant is derived from alkyl phenols present in the heavy naphtha, and (iii) the light naphtha has a lower concentration of alkyl phenols than the heavy naphtha;

(b) extracting mercaptan sulfur from the light naphtha to the extractant;

(c) contacting in a second contacting region the heavy naphtha with the extractant, wherein, (i) the heavy naphtha has a higher boiling range than the light naphtha, and (ii) the heavy naphtha has a higher concentration of alkylphenols than the light naphtha, (d) extracting mercaptan sulfur and alkylphenols from the heavy naphtha to the extractant;

(e) separating an upgraded light naphtha and separating an upgraded heavy naphtha; and (f) separating mercaptan sulfur from the extractant, and then conducting the extractant to at least step (a) for re-use.

16. The method of claim 15 wherein the heavy naphtha contains a hydrotreated naphtha and at least a portion of the mercaptans are reversion mercaptans having a molecular weight greater than about $C_4$.

17. The method of claim 16 wherein the hydrotreated naphtha is a selectively hydrotreated naphtha and wherein the reversion mercaptans have a molecular weight greater than about $C_5$.

18. The method of claim 15 wherein, during the contacting of steps (a) and (c), the extractant is applied to and flows over and along hydrophylic metal fibers, and the naphtha flows over the extractant co-current with a first phase flow thereof.

19. The method of claim 15 wherein the treatment composition is formed by combining water in an amount ranging from about 10 wt. % to about 50 wt. %, alkali metal hydroxide in an amount ranging from about 25 wt. % to about 60 wt. %, sulfonated cobalt phthalocyanine in an amount ranging from about 10 ppm to about 500 ppm, and alkylphenols in an amount ranging from about 10 wt. % to about 50 wt. %, based on the weight of the treatment solution.

20. The method of claim 19 wherein the extractant is present in an amount ranging from about 3 vol. % to about 100 vol. %, based on the volume of the naphtha, and wherein the extractant contains dissolved alkali metal hydroxide in an amount ranging from about 1 wt. % to about 40 wt. %, dissolved alkali metal alkylphenylate ions in an amount ranging from about 10 wt. % to about 95 wt. %, and sulfonated cobalt pthalocyanine in an amount ranging from about 10 ppm to about 500 ppm, based on the weight of the extractant.

21. The method of claim 20 wherein the sulfonated cobalt phthalocyanine is cobalt phthalocyanine disulfonate.

22. The method of claim 21 wherein the contacting of steps (a) and (c) is conducted in the substantial absence of oxygen.

23. The method of claim 22 wherein the mercaptan sulfur is separated from the extractant in step (t) by (i) converting the mercaptan sulfur to hydrocarbon-soluble disulfides in an oxidizing region in the presence of oxygen and a catalytically effective amount of sulfonated cobalt pthalocyanine, (ii) separating the disulfides from a first phase of the extractant, and then (iii) conducting the extractant to at least one of steps (a) and (c) for re-use.

* * * * *